US005259354A

United States Patent [19]

Sausner et al.

[11] Patent Number: 5,259,354

[45] Date of Patent: Nov. 9, 1993

[54] DEVICE FOR THE PRE-MEASURED INPUT OF VOLATILE FUEL COMPONENTS INTO THE INTAKE TUBE OF AN INTERNAL COMBUSTION ENGINE

[75] Inventors: Andreas Sausner, Frankfurt am Main; Sebastian Zabeck, Hemsbach, both of Fed. Rep. of Germany

[73] Assignee: Firma Carl Freudenberg, Weinheim/Bergstr., Fed. Rep. of Germany

[21] Appl. No.: 748,284

[22] Filed: Aug. 21, 1991

[30] Foreign Application Priority Data

Aug. 30, 1990 [DE] Fed. Rep. of Germany ..... 4027397

[51] Int. Cl.[5] ..... F02M 33/02

[52] U.S. Cl. ..... 123/520; 123/376

[58] Field of Search ..... 123/376, 518, 516, 519, 123/520, 521

[56] References Cited

U.S. PATENT DOCUMENTS

| | | | |
|---|---|---|---|
| 1,899,038 | 2/1933 | Junkers | 123/376 |
| 2,396,618 | 3/1946 | Stieglitz | 123/376 |
| 3,391,679 | 7/1968 | Williams | 123/518 |
| 3,456,635 | 7/1969 | Hervert | 123/519 |
| 3,554,175 | 1/1971 | Sarto | 123/519 |
| 4,059,081 | 11/1977 | Kayanuma | 123/520 |
| 4,326,489 | 4/1982 | Heitert | 123/520 |
| 4,397,276 | 8/1983 | Hayashida | 123/376 |
| 4,467,601 | 8/1984 | Watanabe | 123/376 |
| 4,771,847 | 9/1988 | Michell | 123/376 |

FOREIGN PATENT DOCUMENTS

| | | | |
|---|---|---|---|
| 0034014 | 3/1978 | Japan | 123/520 |
| 0144516 | 11/1979 | Japan | 123/519 |
| 0154154 | 11/1981 | Japan | 123/519 |

*Primary Examiner*—Carl S. Miller
*Attorney, Agent, or Firm*—Kenyon & Kenyon

[57] ABSTRACT

A device for the temporary storage and the pre-measured input of the volatile fuel components located in the free space of a tank into the intake tube of an internal combustion engine. The device includes a ventilator line that connects the free space with the atmosphere, into which line a storage chamber with an absorption element is placed, and a connecting line, which connects the storage chamber with the intake tube. The line may be closed by means of a valve, so that it operates in synchronicity with the butterfly valve of the intake tube.

15 Claims, 6 Drawing Sheets

DEVICE FOR THE PRE-MEASURED INPUT OF VOLATILE FUEL COMPONENTS INTO THE INTAKE TUBE OF AN INTERNAL COMBUSTION ENGINE

BACKGROUND OF THE INVENTION

The invention relates generally to a device for the temporary storage and the pre-measured input of the volatile fuel components located in the free space of a tank into the intake tube of an internal combustion engine, and more particularly to such a device comprising a ventilator line connecting the free space with the atmosphere. The line leads to a storage chamber containing an absorption element. A line also connects the storage chamber and the intake tube, which may be closed by means of a valve, such that the valve and butterfly valve may be operated in tandem.

German patent 38 02 664 discloses a device in which a valve and a butterfly valve may be activated independently of each other. Activation of the butterfly valve is accomplished with mechanical means, and activation of the valve is accomplished by the aid of electronic and electromechanical means. These means communicate by signal with each other, and are connected to sensors that continually collect various characteristic data from the internal combustion engine in the course of engine operation. The construction and installation of such a device is correspondingly costly.

The invention is directed towards the further development of a device for the pre-measured input of volatile fuel components into the intake tube of an internal combustion engine that has a simplified construction and is simple to install.

SUMMARY OF THE INVENTION

In the invention, a line valve and an intake tube butterfly valve are operated in tandem by a commonly shared activation device. This device both assists in the proper operation of the internal combustion engine, as well in providing a proper input of volatile fuel components into the intake tube; yet does not require an excessive expenditure in terms of the production or the installation of the requisite parts. Consequently, the device can be used in the production of more inexpensive motor vehicles than is the case with other, more expensive vapor recovery systems.

The configuration of the device depends to a degree upon the embodiment of the means of operating the valve and the butterfly valve. In the typical case, the butterfly valve is firmly affixed to an activating shaft so that the desired adjustment of the valve is affected by a relative rotation of the activating shaft. By contrast, in the case of line valves, one would typically affect a change in the flowthrough profile by means of a linearly reciprocating motion of an adjustment component that describes a straight line. The joint activation of both the line valve and the intake tube butterfly valve thus requires the use of means of activation that can accommodate the transformation of a back and forth motion into a rotating motion. A large number of mechanical aids are known that can accomplish this task.

For example, one could use a spindle gear to arrange the adjusting component of the valve on an axis of motion that forms an elongation of the axis of rotation of the butterfly valve shaft. Production is particularly simple, with the additional advantage that the housing of the valve can be positioned in the immediate vicinity of the intake tube or, if required, be made an integral component of the latter.

In one embodiment, the activation device takes the form of a cam gear. This helps to simplify adjustments to the opening characteristics of the butterfly valve and the valve, with respect to one another in a way that optimizes the operational characteristics of the individual internal combustion engine. By providing a cam plate that is interchangeable, the device can be used with internal combustion engines of various sizes by means of the simple exchange of a cam plate.

The activation device can comprise a cogwheel mechanism, which renders it possible to bridge spatial distances between the butterfly valve shaft and the adjustment element of the valve. Alternatively, the activation device may be formed by a connecting rod mechanism. In the latter case, the production costs are comparatively lower, but it is necessary to create a static initial load (e.g., by means of a pressure spring) to suppress undesired play.

For the case of valves, in which the adjustment component may be activated by means of a relative rotation, one may provide for a slide shaft connection between the butterfly valve shaft and the shaft of the corresponding adjustment component of the valve. The corresponding opportunity to adjust the opening characteristics to one another in an effective manner immediately presents itself, depending upon the radial distances between the individual control point of the slide shaft and the axis of rotation of the adjustment component.

Bowden cables can be used to provide an oscillatory detachment of the valve from the butterfly valve shaft, and also provide long-term resistance to wear. Cam drives may also be used.

The activation device of the valve can include a booster control which is controlled by an electric, hydraulic, or pneumatic coupling via the butterfly valve or its associated activation means. In such an embodiment, the activation characteristics of the valve can be adapted to the special requirements of the particular application at hand.

The auxiliary power of the valve may comprise a spring element to counterbalance any play in the means of activation used. Here, the spring acts as a pressure spring and is arranged so that the release of pressure causes a transfer of the positioning element of the valve to the closed position.

An even more sensitive controlling characteristic of the valve can be achieved if an auxiliary valve is added to the former in the direction of the absorption element, so that the auxiliary valve can be activated by means of an electric signal, and is connected to a control device. In the control device, sensors enable characteristic operational data from the internal combustion engine to be continually processed so that the output signal optimizes control of the valve. In addition to optimizing the operation of the internal combustion engine, these means make possible a significant reduction in environmental pollution caused by the engine's operation. To this end, the control device should be equipped with at least one sensor for the continuous monitoring of data concerning characteristic operating parameters of the internal combustion engine, as well as a servomechanism for controlling the device as a function of the data.

The valve can be equipped with a device to provide relatively delayed opening and closing of the valve that is synchronous with that of the butterfly valve. Such a device can, for example, be formed of an asymmetrical hydraulic damper. Such hydraulic dampers are known—they are used in the area of wheel suspension in motor vehicles. In the present application, they may be used to cause a time-delayed opening and synchronous closing of the valve with respect to the relative motion of the butterfly valve.

DETAILED DESCRIPTION

Figure 1:
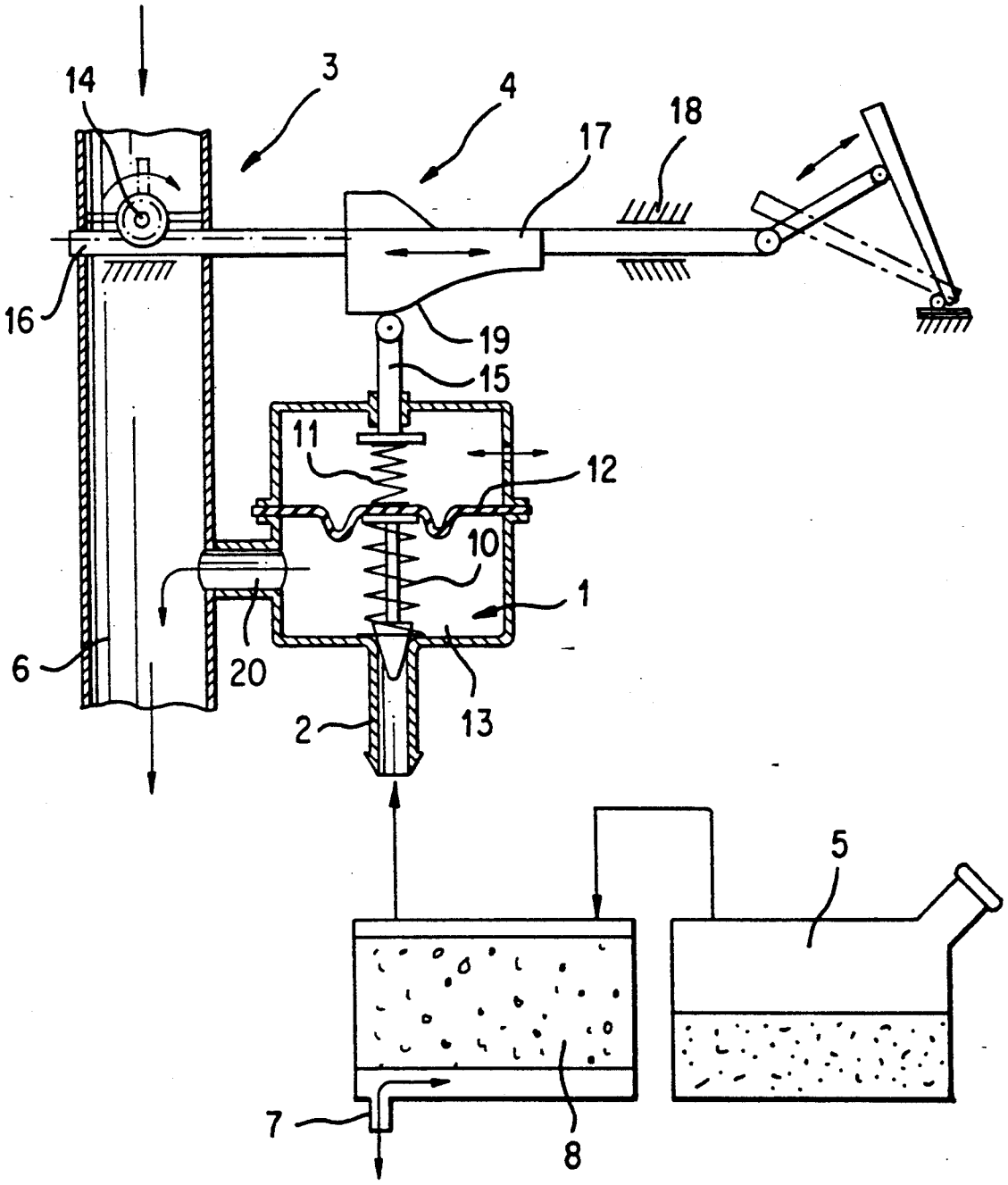
FIG. 1 shows in schematic form the general arrangement of elements of the device.
Figure 2:
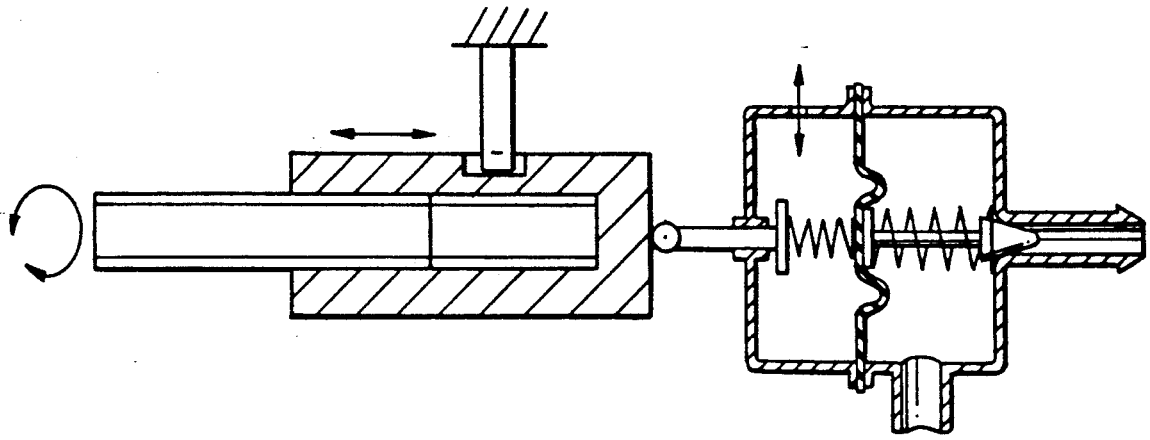
FIG. 2 illustrates in schematic form a portion of the device of FIG. 1 in which a spindle gear is utilized.
Figure 3:
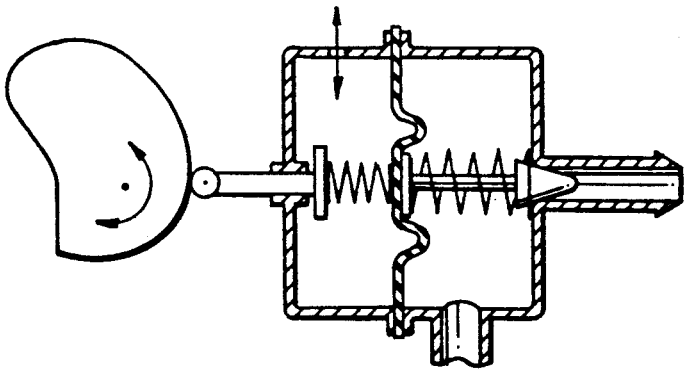
FIG. 3 illustrated in schematic form a portion of the device of FIG. 1 in which a cam gear is utilized.
Figure 4:
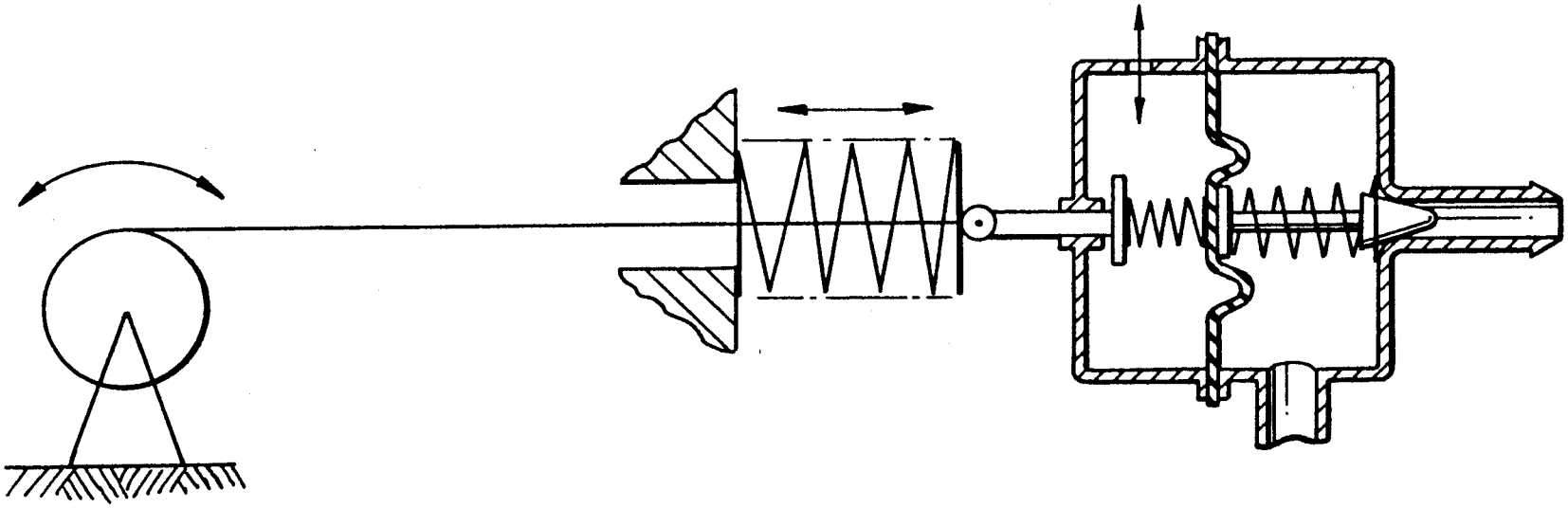
FIG. 4 illustrates in schematic form a portion of the device of FIG. 1 in which a Bowden cable is utilized.
Figure 5:
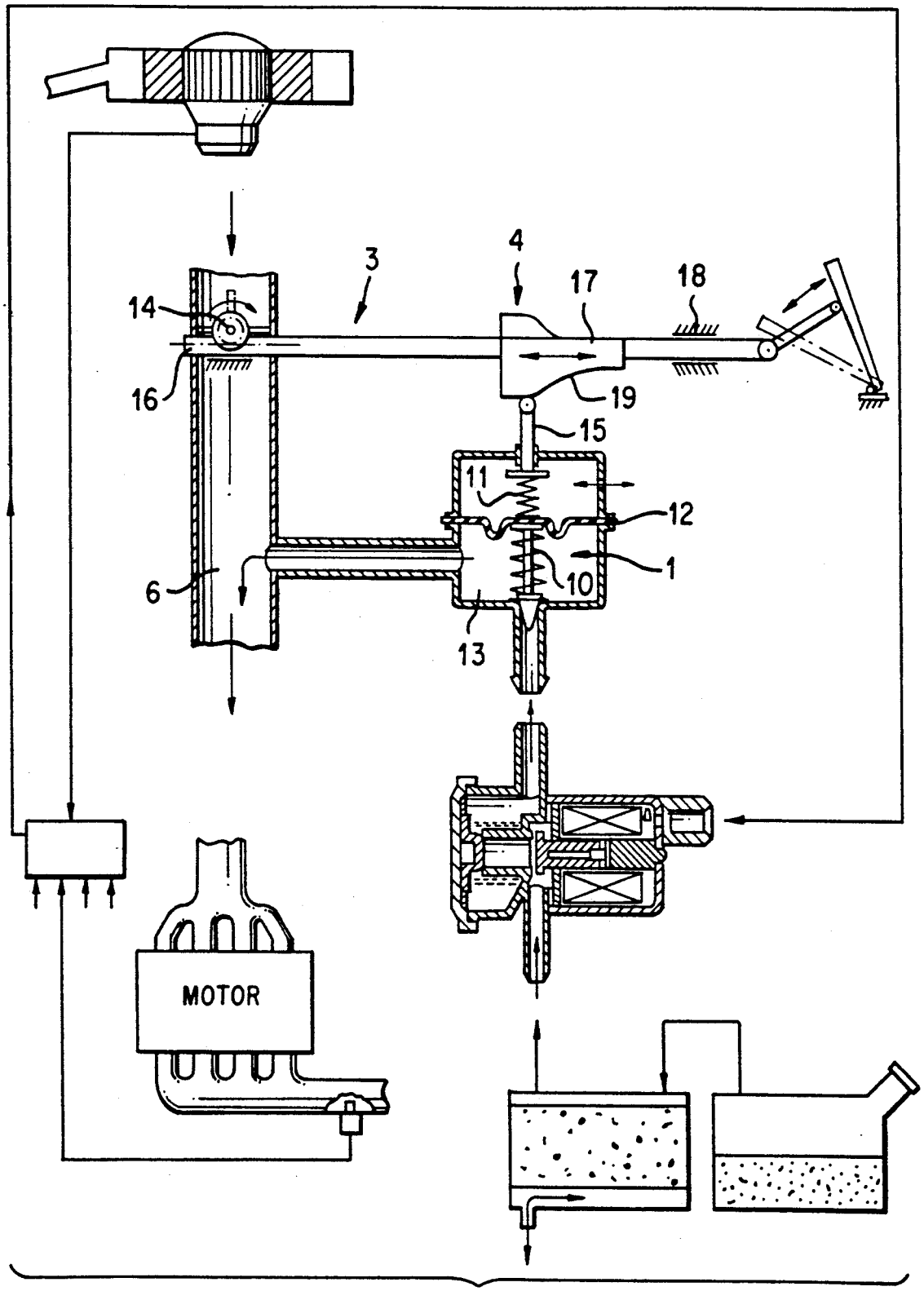
FIG. 5 illustrates in schematic form the control structure for an auxiliary valve.
Figure 6:
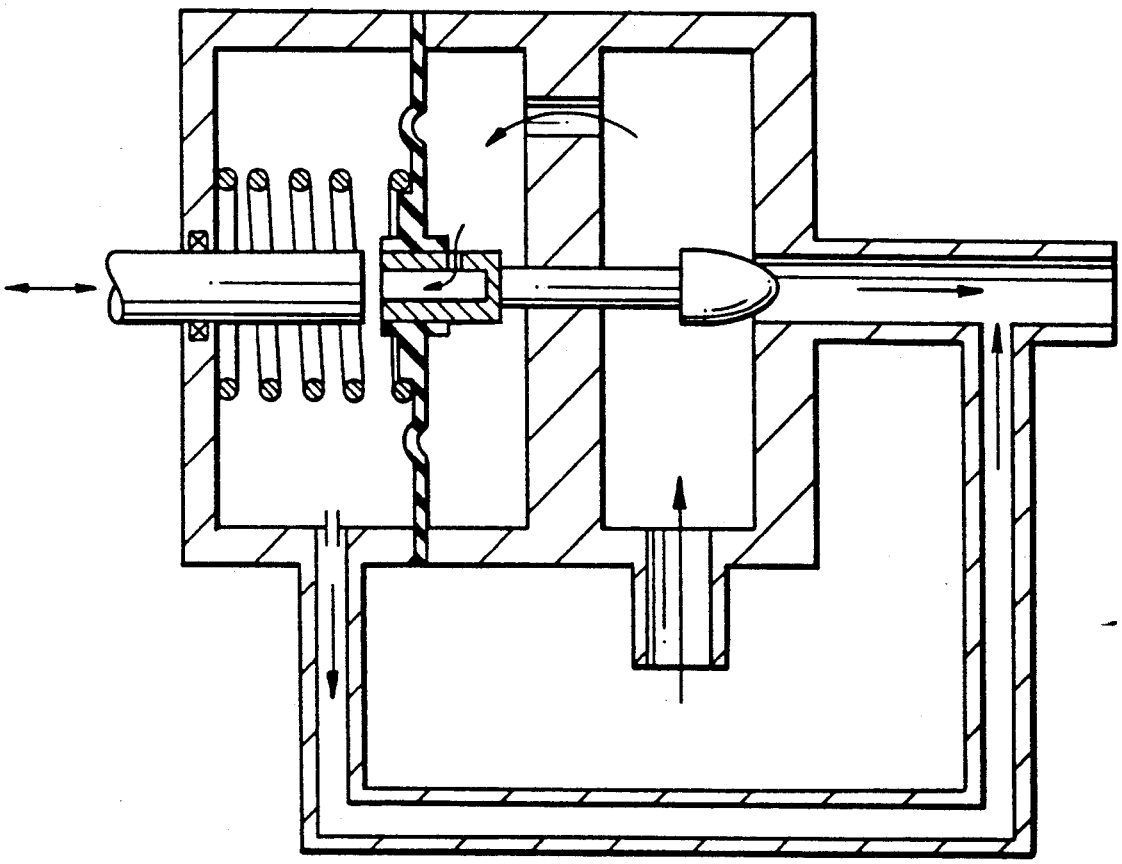
FIG. 6 illustrates in schematic form structure for delaying the opening of a valve.
Figure 7:
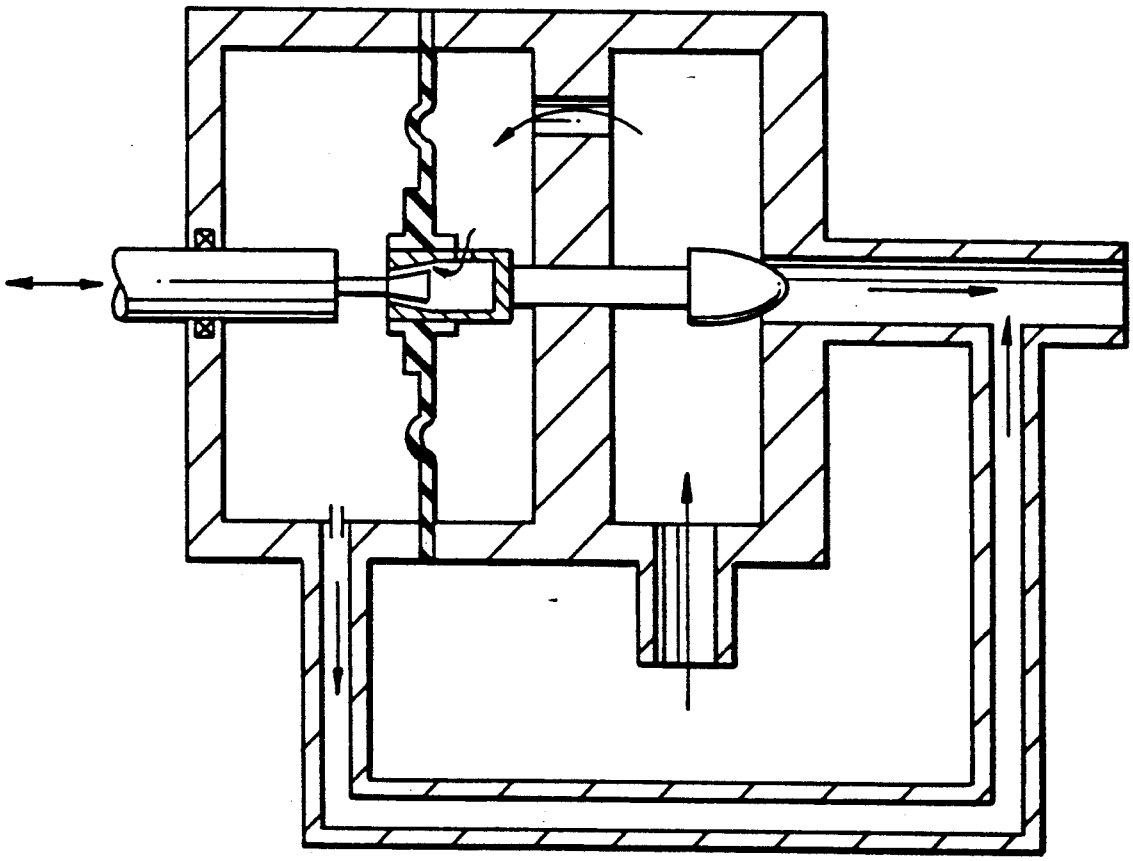
FIG. 7 illustrates in schematic form an asymmetrical hydraulic damper.

The FIGURE shows a device for the temporary storage and pre-measured input of the volatile fuel components located in the free space of a tank into the intake tube 6 of an internal combustion engine. In this device, provision is made for a ventilation line 7, that connects free space 5 with the atmosphere. The vent line is intercepted by a storage chamber 8, containing an absorption element made of activated carbon. A line connects the free space with the intake tube 6, and may be closed off by means of valve 1. Both the actuation of valve 1 and of butterfly valve 14 are jointly controlled by means 4. They comprise a cogwheel mechanism, which is assigned to butterfly shaft 14, and a cam plate, which is assigned to the adjustment component 15.

The cogwheel mechanism includes a gear that is attached to butterfly valve shaft 14 in such a way as to be incapable of rotation with respect to shaft 14, and a toothed rack 16, which is in mesh with the gear. The toothed rack 16, is seated in a guide 18, and is movable only in the horizontal direction. In its middle area, it bears a cam plate, which is in contact with the adjustment component 15 of valve 1.

Due to the curved profile of guide path 19 of the cam plate 17, the back and forth motion of toothed rack 16 yields a perpendicular up and down motion of the adjustment component 15 of valve 1. The opening motion of valve 1 is also influenced by the pressure within intake tube 6. This pressure is transferred by way of a line 20 into a control chamber 13, which is bounded in the direction of the atmosphere by means of adjustment membrane 12. Adjustment membrane 12 is subjected to pressure on its underside by means of a pressure spring 10, and on its upper side, by means of an additional spring 11.

In the illustrated position of the device, the accelerator pedal is in its uppermost position, and both the butterfly valve 3 and the valve 1 are closed. Vapors that are being liberated in the area of the fuel container are led off to the outside from the container's upper region 5, by way of line 2, through absorption element 8 and line 7. In this process, the fuel components are absorbed within absorption element 8, and consequently hindered from escaping to the outside.

As driving is commenced, the accelerator is depressed and toothed rack 16 to which the accelerator is mechanically linked is moved linearly toward the left within the plane of projection via guide 18. This linear motion cooperates with the pivoting structure of the butterfly valve 3 to place it in an open position. Concomitantly, this linear movement cooperates with adjustment component 15 to lift the latter. The reduced pressure that occurs in intake tube 6 upon opening of the butterfly valve is transferred through line 20 to storage chamber 13. It is immediately adjacent to the underside of adjustment membrane 12, and is modified by the presence of pressure spring 10 and spring 11 in such a way that an optimal opening motion of valve 1 results, allowing fuel vapors to flow into the intake tube.

What is claimed is:

1. A device for the temporary storage and pre-measured input of the volatile fuel components located in the free space of a tank into the intake tube of an internal combustion engine, comprising:

a ventilator line connecting the free space of a fuel storage tank with the atmosphere;

a storage chamber connected to said line, said storage chamber containing an absorption element;

a line connecting the storage chamber with the intake tube of an engine;

a butterfly valve associated with the intake tube for regulating the air intake through said intake tube;

a second valve disposed between the intake tube and the line leading from the storage chamber, said second valve, storage chamber, and free space being connected so that when said second valve is in an open state, the free space is in fluidic communication with the storage chamber and intake tube; and activation means for jointly operating both the butterfly valve and the second valve.

2. The device of claim 1, wherein the activating means comprises a spindle gear.

3. A device of claim 1, wherein the activating means comprises a cam gear.

4. The device of claim 1, wherein the activating means includes a cogwheel mechanism.

5. The device of claim 1, wherein the activating means includes a connecting rod mechanism.

6. The device of claim 1, wherein the activating means includes a slide shaft connection.

7. The device of claim 1, wherein the activating means comprises a Bowden cable.

8. The device of claim 1, wherein the activating means is controlled via a cam drive.

9. The device of claim 1, wherein the activating means includes an auxiliary operating system for the second valve.

10. The device of claim 9, wherein the auxiliary operating system includes a spring element.

11. The device of claim 9, wherein the auxiliary operating system comprises an adjustable membrane supported on a spring, and the adjustable membrane forms the demarcation between a control chamber that is connected to the intake tube and the atmosphere.

12. The device of claim 1, further comprising an auxiliary valve added to the second valve in the direction of the absorption element, wherein the auxiliary valve may be activated by means of an electrical signal, and is connected to a controlling device in such a way as to be able to conduct a signal.

13. The device of claim 12, wherein the control device is equipped with sensors for the continual collection of characteristic data from the internal combustion engine, as well as with an adjustment device to optimize the signal in relation to the value of the characteristic data in each case.

14. The device of claim 1, wherein the operating device of valve is provided with a device for the relatively delayed opening and closing of the second valve so as to be synchronized to the movement of the butterfly valve.

15. The device of claim 14, wherein the device includes an asymmetrical hydraulic damper.

* * * * *